US005794932A

United States Patent [19]

Gastone

[11] Patent Number: 5,794,932

[45] Date of Patent: Aug. 18, 1998

[54] DEVICE FOR A TABLE GAME WITH MULTIPLE CHESS-BOARDS SUPERIMPOSED ONE UPON THE OTHER, AND SPATIAL MOVEMENTS

[76] Inventor: Fiori Gastone, via Tuscolana 937 - 00174, Rome, Italy

[21] Appl. No.: 318,781

[22] PCT Filed: Jul. 20, 1993

[86] PCT No.: PCT/IT93/00076

§ 371 Date: Oct. 17, 1994

§ 102(e) Date: Oct. 17, 1994

[87] PCT Pub. No.: WO94/21342

PCT Pub. Date: Sep. 29, 1994

[30] Foreign Application Priority Data

Mar. 24, 1993 [IT] Italy ..... RM93A0185

[51] Int. Cl.[6] ..... A63F 3/00

[52] U.S. Cl. ..... 273/241

[58] Field of Search ..... 273/241, 260, 273/261

[56] References Cited

U.S. PATENT DOCUMENTS

| | | | |
|---|---|---|---|
| 3,656,755 | 4/1972 | Thompson | 273/241 |
| 3,806,124 | 4/1974 | Ippen et al. | 273/241 |
| 4,019,743 | 4/1977 | Castanis | 273/241 |
| 4,883,278 | 11/1989 | Scott | 273/241 |
| 5,031,917 | 7/1991 | Greene | 273/241 |
| 5,033,751 | 7/1991 | Ching | 273/241 |
| 5,338,040 | 8/1994 | Cutler | 273/241 |

OTHER PUBLICATIONS

"Three-Dimensional Chess", *Time*, Feb. 4, 1952, p. #15, copy in 273/241.

"Space Chess", Sears, Jan. 1976, copy in 273/241.

*Primary Examiner*—William E. Stoll

*Attorney, Agent, or Firm*—Beveridge, Degrandi, Weilacher, Young, LLP

[57] ABSTRACT

A board game that features a plurality of game-boards and a support structure such as a central column joined with the game-boards. The plurality of game-boards include an upper transparent game-board, an intermediate transparent game-board and a base game-board. Each game-board has an upper playing field lying flush with one of three horizontal planes that are vertically spaced from one another. Each of the playing fields includes two sets of parallel lines with the sets arranged orthogonal to each other so as to define a plurality of intersecting paths which intersect at intersection points. A plurality of the paths extend diagonally off of external peripheral edges of the playing fields of corresponding game-boards, with each playing field being multi-sided such as an eight sided playing field. The board game also includes a first series of game pieces which includes a first, a second and a third game piece type. Also included is a second series of game pieces visually distinct from the first series of game pieces. The second series of game pieces includes a first, second and third game piece type that is similarly configured with the three different types in the first series.

2 Claims, 2 Drawing Sheets

DEVICE FOR A TABLE GAME WITH MULTIPLE CHESS-BOARDS SUPERIMPOSED ONE UPON THE OTHER, AND SPATIAL MOVEMENTS

FIELD OF THE INVENTION

The present invention concerns a device which includes means for realizing a table game. The device comprises multiple game-boards superimposed one upon the other and 'men' to be spatially moved.

SUMMARY OF THE INVENTION

The device according to the present invention is a complete novelty as it allows a player to play on different spatial planes with new means and rules.

The device according to the present invention includes a plurality of transparent planar game-boards superimposed one upon the other and linked one to the other. Two sets of parallel lines are provided on each game-board with the lines in one set crossing orthogonally with the lines in the other set so as to form a plurality of intersecting diagonally extending paths on the face of each board. The board game of the invention features three series of 'men', with each series having three different structure types. In playing the game in accordance with the rules of the game, a man is moved along the game-board supporting that man while consideration is given to the relative type and position of men on both the non-supporting and supporting game-boards. Particularly, consideration is given to the type of the man being moved and the type and relative positioning of the men on the other transparent game-boards with respect to a vertical viewpoint, a reflected semi-diagonal viewpoint and a diagonal viewpoint.

BRIEF DESCRIPTION OF THE DRAWINGS

The device according to the present invention will be described hereinbelow relating to the enclosed drawings, in which a preferred embodiment is shown.

FIG. 4: shows an example of a diagonal viewpoint under the rules, with two 'men' A and one opponent B on the three planes (catching of the black 'man');

FIG. 5: shows a second example of a diagonal viewpoint under the rules, with two 'men' A and one opponent C on the three planes (catching of the white 'man');

FIG. 6: shows an example of a semi-diagonal reflected viewpoint under the rules, with two 'men' B and one opponent C on two of the three planes (catching of the black 'man');

FIG. 7: shows a second example of a semi-diagonal reflected viewpoint under the rules, with two 'men' B and one opponent A on two of the three planes (catching of the black 'man');

FIG. 8: shows an example of a vertical viewpoint under the rules, with two 'men' C and one opponent A on the three planes (catching of the black 'man');

FIG. 9: shows a second example of the vertical viewpoint under the rules, with two 'men' C and one opponent A (catching of the black 'man').

DETAILED DESCRIPTION OF THE PREFERRED EMBODIMENT(S)

Figure 1:
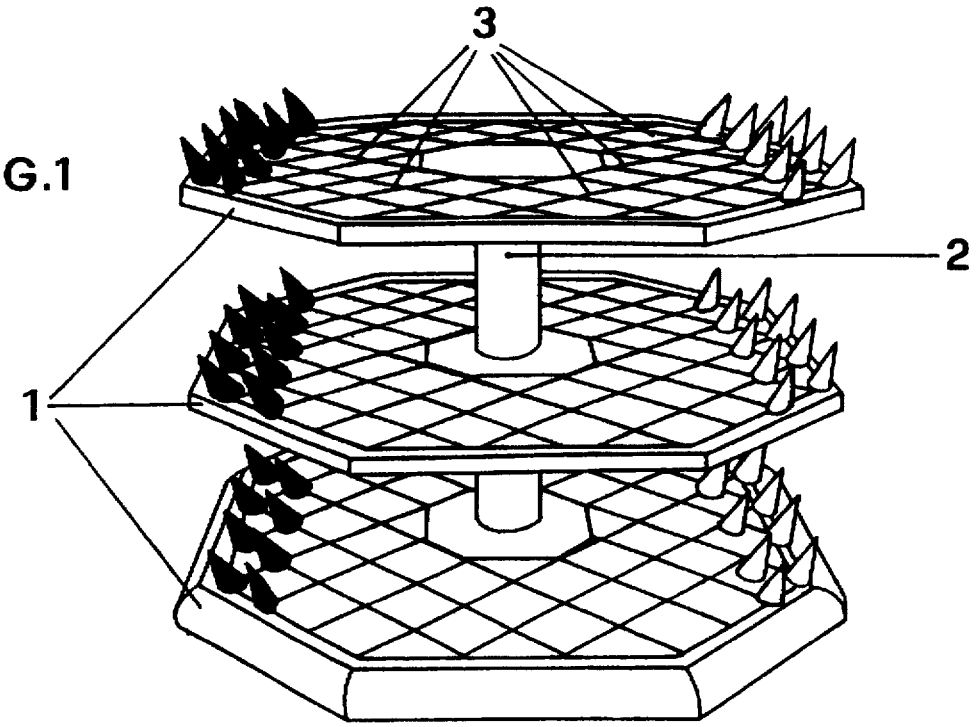
FIG. 1 shows an axonometric view of a variant with three planar game-boards of the device according to the present invention.

Relating now to the details of the enclosed figures, the device for the table game with multiple game-boards superimposed one upon the other and spatial movements includes:

three transparent game-boards 1 superimposed one upon the other, and linked by a small central column 2;

two sets of lines 3 on each plane 1, with a first set of lines crossing the other set on a common plane in such a way as to form a plurality of diagonal paths which define seventy-two crossings or intersection points 4;

two series of twenty-seven pieces, different in colour, and with each series comprising fifteen 'men' A, six 'men' B and six 'men' C, that are provided for being placed respectively in the number of five, two and two for each colour and opposite on each plane, on the starting fields of the game-boards.

Figure 2:
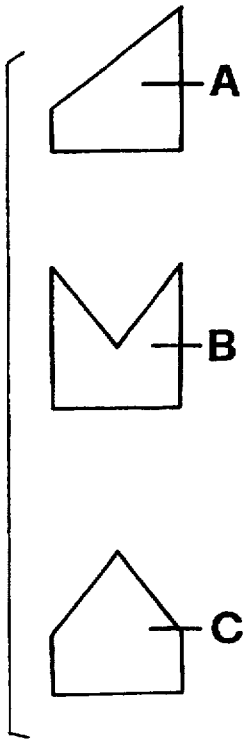
FIG. 2 shows a lateral view of three possible different shaped types for the 'men'.
Figure 3:
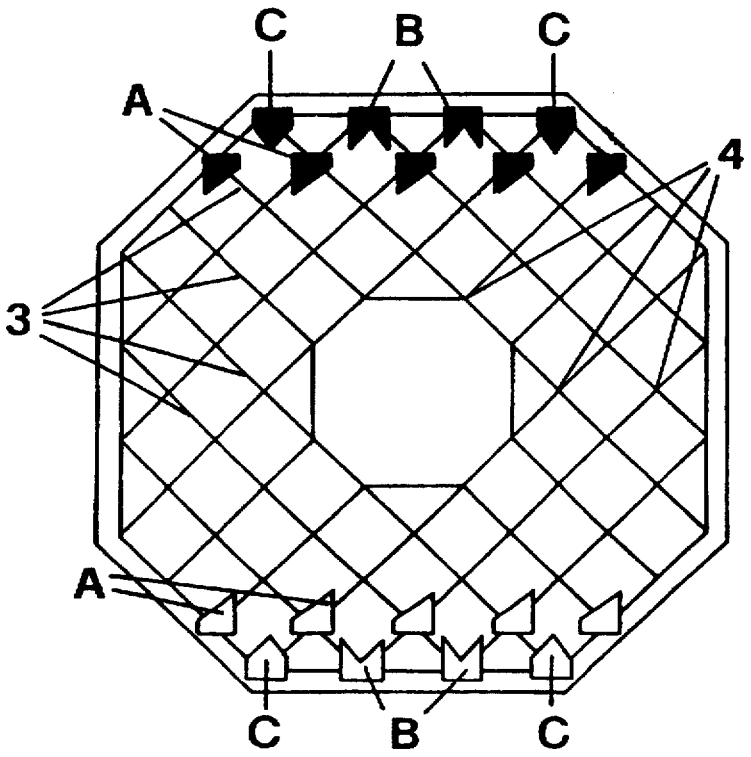
FIG. 3 shows one of the game-boards of the complete device, with the pool position of the 'men'.
Figure 4:
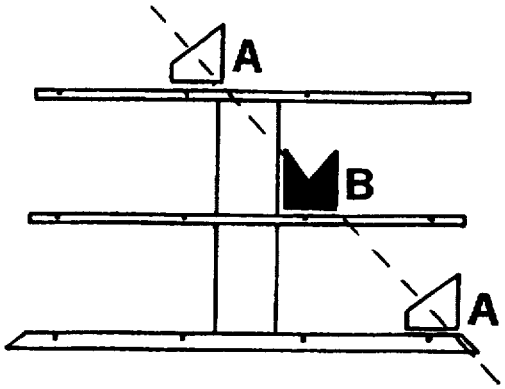
FIGS. 4, 5, 6, 7, 8 and 9 show six possible game conditions.
Figure 5:
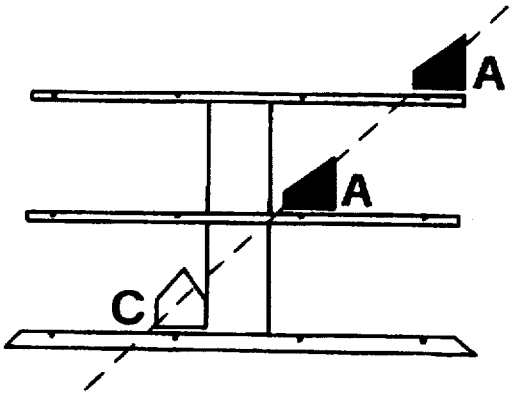
Figure 6:
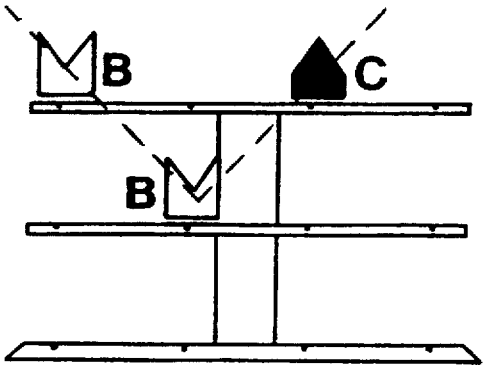
Figure 7:
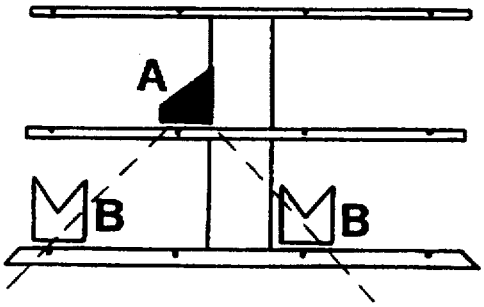

As shown in FIG. 1, each game-board has a similar sized playing field and a common peripheral shape such as an octagonal shape. Also, as shown in FIG. 1, each playing field includes a central area free of the paths with each central area having a peripheral edge defining a greater area than that of a horizontal cross-section of the central support column. The lower game-board is also shown to be thicker in vertical width. The game pieces in FIG. 1 are shown schematically while FIGS. 2 and 3 show the game pieces in detail.

The game is performed on each game-board 1 and at the same time on all three of the game-boards, thus conferring to the game a very high number of possibilities.

On each game-board 1, the men A, B and C are moved along the diagonal paths, and all in the same manner. This movement of a man has the potential for producing one of the viewpoints under the rules discussed above wherein 'men' A play in the diagonal viewpoint sense, 'men' B in the reflected semi-diagonal viewpoint sense and 'men' C in the vertical viewpoint sense. The three different viewpoints are illustrated by the dash lines in FIGS. 4–9 and are shown either diagonally oriented along the three planes assumed by the planar gameboards, vertically oriented across three planes or in a semi-diagonal reflection arrangement in either the top two or the bottom two of the three planes.

In playing the game, it is first determined which player will make the first move. Each player, in turn, then makes a move on one of the three planes, moving one of the 'men' in any diagonal direction, extending out from the intersection point 4 on which the to be moved man is positioned. In moving the man, the person moving chooses each time one of the nearby, free crossings 4 with the purpose of catching the 'men' of the opponent.

The catching of the opponent's 'man' may occur in two different ways:

1) on each plane 1, jumping over the opponent 'man', if the next crossing 4 is free.

Figure 8:
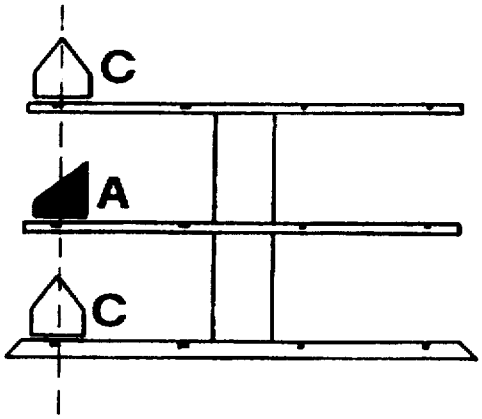
Figure 9:
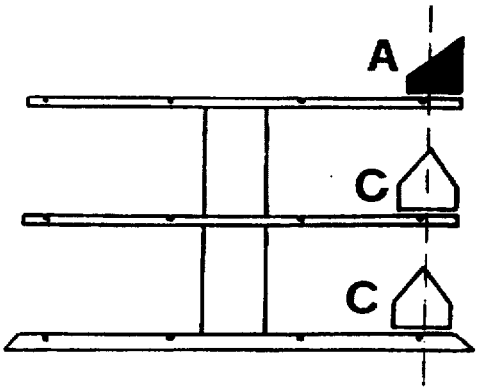

2) In the three planes, the cleverness of the player consists in combining the moves made on the single planes in the following combinations of the three planes: the 'man' A being moved must define a diagonal viewpoint across the three planes both with respect to one other 'man' A of the same color and one of the opponent's men; the 'man' B being moved must define a reflected semi-diagonal viewpoint with respect to one other 'man' B of the same color and anyone of the opponent's men, placed in any way on the two planes (FIGS. 6, 7); the 'men' C must define a vertical with two 'men' C and an opponent, placed in any way on the three planes (FIGS. 8, 9).

The game with the means forming the device according to the present invention ends when one player leaves his opponent without 'men' A, B and C or when he puts his opponent in the condition that he can not make any move.

I claim:

1. A board game, comprising;

a support structure;

three transparent game-boards joined with said support structure so as to be vertically separated from one another and such that an upper playing surface of each gameboard defines a respective one of a first, second and third horizontal plane, wherein the external shape of the upper playing surface of each game board is defined by a multi-sided peripheral edge, and each of said game-boards having two sets of parallel paths with said sets being arranged orthogonal to each other on the playing surfaces with a plurality of the paths extending diagonally off from peripheral edges of the playing surface on which said paths are formed;

a first series of game pieces which first series includes a first, a second and a third game piece type with the three game piece types being different;

a second series of game pieces that is visually distinct from said first series and includes first, second and third game piece types which correspond with the first, second and third game piece types of said first series, and wherein said support structure includes a column positioned centrally with respect to said first, second and third game boards, and wherein each of the game boards provides a similar sized playing surface and each playing surface has a similarly shaped peripheral edge.

2. A board game, comprising;

a support structure;

a plurality of game-boards supported by said support structure so as to be vertically separated from one another, and said plurality of game boards including an upper transparent game board, an intermediate transparent game board and a lower game board with an upper playing surface of each game board defining a respective one of a first, second and third horizontal plane, each of said game boards having two sets of parallel paths with said sets being arranged orthogonal to each other so as to define a plurality of intersection points;

a first series of game pieces which series consists of a first, a second and a third game piece type with each game piece type being different than the other two types;

a second series of game pieces that are differently colored than said first series, and said second series consisting of first, second and third game piece types which correspond with the first, second and third game piece types of said first series, and wherein a plurality of said parallel paths extend diagonally off from a peripheral edge of a corresponding one of the playing surfaces of said game-boards.

* * * * *